US006609641B2

(12) United States Patent
Sutton

(10) Patent No.: US 6,609,641 B2
(45) Date of Patent: Aug. 26, 2003

(54) CLAMP-TYPE GARMENT HANGER

(75) Inventor: Steven Sutton, Brooklyn, NY (US)

(73) Assignee: The Accessory Corporation, New York, NY (US)

( * ) Notice: Subject to any disclaimer, the term of this patent is extended or adjusted under 35 U.S.C. 154(b) by 0 days.

(21) Appl. No.: 10/287,346

(22) Filed: Nov. 4, 2002

(65) Prior Publication Data

US 2003/0080164 A1 May 1, 2003

Related U.S. Application Data

(63) Continuation-in-part of application No. 09/891,789, filed on Jun. 26, 2001, now Pat. No. 6,474,517.

(51) Int. Cl.[7] ..... A47G 25/14
(52) U.S. Cl. ..... 223/96
(58) Field of Search ..... 223/90, 91, 93, 223/96, 95, 85

(56) References Cited

U.S. PATENT DOCUMENTS

| | | | | | |
|---|---|---|---|---|---|
| 2,496,531 | A | * | 2/1950 | Gray | 223/96 |
| 2,496,631 | A | | 2/1950 | Gray | 223/96 |
| 4,023,721 | A | | 5/1977 | Erthein | 223/96 |
| 4,194,274 | A | | 3/1980 | Garrison | 24/248 R |
| 4,209,879 | A | | 7/1980 | Paajanen | 24/248 R |
| 4,395,799 | A | | 8/1983 | Batts | 24/137 A |
| RE32,269 | E | | 10/1986 | Bisk et al. | 223/91 |
| 4,660,750 | A | | 4/1987 | Blanchard | 223/91 |
| 4,714,183 | A | | 12/1987 | Tontarelli | 223/91 |
| 4,716,634 | A | | 1/1988 | Fan | 24/545 |
| 4,746,039 | A | | 5/1988 | Batts et al. | 223/96 |
| 4,984,721 | A | | 1/1991 | Eiley et al. | 223/96 |
| 5,072,886 | A | | 12/1991 | Kolton et al. | 223/91 |
| 5,178,306 | A | * | 1/1993 | Petrou | 223/96 |
| 5,350,092 | A | * | 9/1994 | Hollis | 223/96 |
| 5,398,854 | A | | 3/1995 | Blanchard | 223/96 |
| 5,915,605 | A | | 6/1999 | Blanchard | 223/96 |
| 6,019,261 | A | * | 2/2000 | Morgan et al. | 223/96 |
| 6,105,836 | A | * | 8/2000 | Batts et al. | 223/96 |
| 6,119,906 | A | * | 9/2000 | Bond et al. | 223/96 |
| 6,158,635 | A | * | 12/2000 | Batts | 223/96 |
| 6,474,517 | B1 | | 11/2002 | Sutton | 223/96 |

* cited by examiner

*Primary Examiner*—Bibhu Mohanty
(74) *Attorney, Agent, or Firm*—Gordon & Jacobson, P.C.

(57) ABSTRACT

A garment hanger includes a clamp having a pair of jaw members, wherein at least one jaw member is pivotable relative to the other between open and closed positions. The jaw members are provided with rows of teeth. In a first jaw member, six rows of teeth are provided, and the teeth of the second and fifth rows are substantially thicker than the teeth of the other rows. In a second jaw member, six rows of teeth are provided, with the first, third, and fifth rows provided with relatively small teeth, and the teeth in the second, fourth and sixth rows relatively increasing in size. The hanger clamps in accord with the invention have been demonstrated to have superior gripping ability on denim jeans garments, but may be useful to securely grip other garments.

25 Claims, 6 Drawing Sheets

CLAMP-TYPE GARMENT HANGER

This application is a continuation-in-part of U.S. Ser. No. 09/891,789 now U.S. Pat. No. 6,474,517, filed Jun. 26, 2001, which is hereby incorporated by reference herein in its entirety.

BACKGROUND OF THE INVENTION

1. Field of the Invention

The present invention relates to clamp-type garment hangers. More specifically, the present invention relates to a pinch clamp for securing a garment, and particularly denim jeans, to a garment hanger.

2. State of the Art

Clamp-type garment hangers having at least one clamp are well-known for the suspension or hanging of garments such as pants, skirts, etc. The "pinch-type" clamp is a variety of clamp that has a clamp end having a pair of opposed clamp or jaw members between which a portion of the garment is secured, and a handle portion having a pair of spaced apart handles. Provision is made for biasing the jaw members towards each other to create the clamping force necessary to retain a garment between inner surfaces of the jaw members. The jaw end of the clamp is hinged to the handle portion such that squeezing or pinching the handles toward one another, i.e., to reduce the space between the handles, causes the jaw members to open to receive or release a garment. To further retain the garment between the inner surfaces of the members, the clamp or jaw members typically also include inner surfaces gripping elements or friction increasing surfaces.

An example of a pinch-type clamp hanger is shown in U.S. Pat. No. 5,398,854 to Blanchard, which describes a hanger with a clamp having a jaw end, a handle portion at an opposite end from the jaw end, and a hinge point between the two ends. The jaw ends are provided with resilient friction pads to engage a garment provided in the clamp. A C-shaped spring clip provides the means for biasing the jaws to a closed position. Another exemplar pinch-type clamp hanger is shown in U.S. Pat. No. 4,395,799 to Batts. This clamp hanger has two sets of toothed elements on the inside of one of the jaws, which surround a single toothed element on the other of the jaws to secure a garment in the clamp of the hanger.

While the known pinch-type clamp hangers are useful in holding a variety of garments, all the known pinch-type clamp hangers fail at adequately holding denim jeans. The denim of jeans can be relatively thick and heavy, and due to the weight and characteristics of the denim material, jeans tend to be prematurely released from the currently available clamps. When garments are prematurely released from a hanger, garments may be lost or damaged, or the garments must be re-hung in a time consuming and costly process.

SUMMARY OF THE INVENTION

It is therefore an object of the invention to provide a pinch-type garment clamp for a garment hanging device which does not release a jeans garment accidentally during shipping, transportation or handling.

It is another object of the invention to provide a pinch-type garment clamp which retains a jeans garment more securely.

It is a further object of the invention to provide a pinch type garment clamp which readily permits release of the garment when desired.

It is also an object of the invention to provide a secure clamp for a garment hanging device which is inexpensively and easily manufactured.

In accordance with the invention, a hanger has at least one clamp which includes a handle portion connected to a pair of jaw members, wherein at least one jaw member is pivotable relative to the other. The jaw members are capable of being in a closed position where one jaw member is urged towards the other jaw member sufficiently to secure a garment, and an open position where one jaw member is pivoted away from the other jaw member to receive or release the garment. The jaw members are provided with an arrangement of ridges, at least some of which define a plurality of teeth.

In accord with one embodiment of the invention, the ridges are preferably arranged in three rows in each of the jaw members, and each row preferably extends substantially across the respective jaw member. In a first jaw member, a front ridge preferably defines four teeth, a second ridge preferably defines five teeth, and a third ridge preferably defines one elongate tooth. In a second jaw member, a front ridge preferably defines two teeth, a second ridge preferably defines four teeth, and a third ridge preferably defines one elongate tooth.

When the jaw members are in the closed position, the front ridge of the second jaw member is directed toward the base of the front ridge of the first jaw member, the second ridge of the second jaw member is directed toward the base of the second ridge of teeth of the first jaw member, and the third ridge of the second jaw member is directed toward the base of the third ridge of the first jaw member. Each of the ridges preferably has a rear wall which extends substantially perpendicular to the surface on which the respective ridge is located, and a front wall which extends from the surface on which the respective ridge is located to the rear wall such that each of the ridges in cross-section has a cuspid-like appearance.

In accord with another embodiment, the six rows of teeth are arranged in each of the jaw members, with each row preferably extending substantially across the respective jaw member. In a first jaw member, the teeth of the second and fifth rows are substantially thicker than the teeth of the other rows in that jaw member.

When the jaw members are moved into a closed position, the teeth of the fifth row of the first jaw member ride against the front of the teeth of the sixth row of the second jaw member. In addition, the teeth of the second row of the second jaw member abut the upper surfaces of the teeth of the second row of the first jaw member. The other teeth in the second jaw member overlie teeth in respective rows of the first jaw member.

The hanger clamps of the first embodiment of the invention have been demonstrated to have superior gripping ability on denim jeans garments, while the hanger clamps of the second embodiment are suitable for securely gripping jeans as well as other types of garments without damage thereto.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
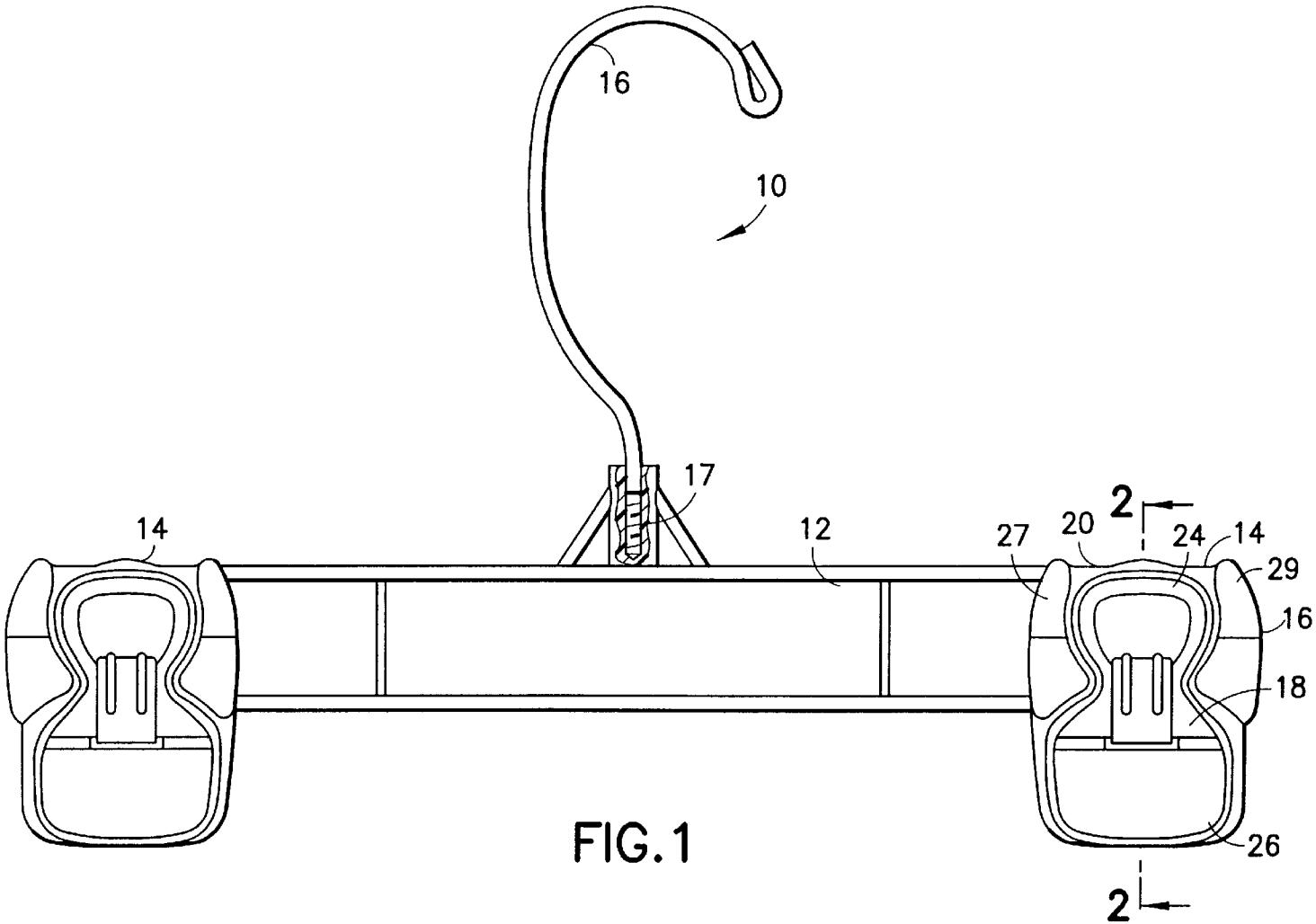
FIG. 1 is a front view of a garment hanger having a clamp according to the invention at each end of a hanger body.

Referring now to FIG. 1, a garment hanger 10 includes a hanger body 12 having at each end a pinch-type clamp 14. Garment hanger 10 includes a partial loop or hook member 16, which may be formed from plastic or metal wire or any other appropriate material. The partial loop or hook member may be secured via threads 17 to the body 12, as shown, or may be integrally formed from the same material as body 12, or may be connected to the body in any other manner. The body 12 is preferably made from any number of well known plastic or resin materials, such as "k"-resin, polystyrene, polypropylene, polyethylene, styrene-butadiene copolymers and blends, polycarbonates, and combinations thereof.

Figure 2B:
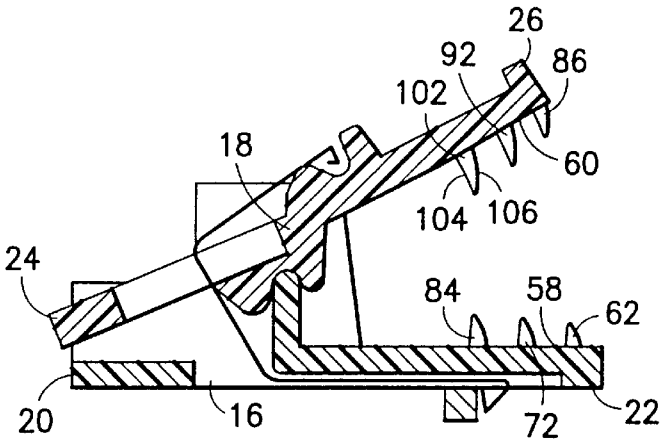
FIG. 2B is a sectional view of the garment clamp according to the first embodiment of the invention taken along line 2—2 in FIG. 1, with the jaw members in a fully open position.
Figure 2A:
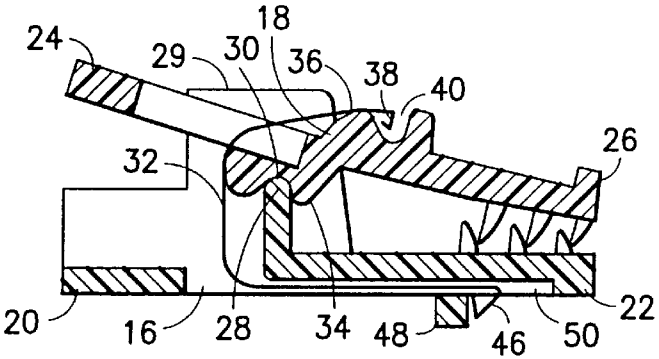
FIG. 2A is a sectional view of the garment clamp according to a first embodiment of the invention taken along line 2—2 in FIG. 1, with the jaw members in a fully closed position.

Referring now to FIGS. 1 and 2A, the clamps 14 are preferably formed from the same material as the body 12. Each clamp 14 has a back base member 16 which is preferably integrally formed with the body, and a front lever member 18 movable relative thereto. The base member 16 includes a handle portion 20 and a jaw end 22, and the lever member 18 includes a handle portion 24 which is opposite handle portion 20, and a jaw end 26 which is positioned opposite jaw end 22. The lever member 18 is pivotally supported on the base member 16 along a pivot wall 28 extending between two supports 27, 29 on the base member 16. The pivot wall 28 is received in a pivot groove 30 on the back of lever member 18. A C-shaped spring clip 32, preferably made of metal, is dimensioned to receive a portion of the base member 16 and a portion of the lever member 18 and is positioned over those portions such that facing inner surfaces of the spring clip 32 bear against outwardly facing surfaces 34, 36 of the base member 16 and the lever member 18, respectively. A front end of the spring clip 32 has a flange 38 that engages within an aperture 40 in the lever member 18 to secure the spring clip 32 to the lever member. A rear end of the spring clip 32 has a tab 46 which engages a strut 48 spanning an aperture 50 in the base member 16 to secure the spring clip to the base member. The spring clip 32 urges the lever member jaw end 26 towards the base member jaw end 22.

Turning now to FIGS. 2B through 6, according to a first embodiment of the invention, each jaw end 22, 26 is provided with a ridged gripping surface 58, 60, respectively, each including an arrangement of three substantially parallel rows of ridges (numbered below). The ridges extend substantially across the respective jaw members in a direction parallel to both the body 12 and the pivot axis of the base and lever members 14, 16. In the jaw end 22 of base member 16, a front ridge 62 is preferably comprised of four relatively smaller elongate teeth 64, 66, 68, 70, a middle ridge 72 is preferably comprised of five relatively smaller elongate teeth 74, 76, 78, 80, 82, and a back ridge 84 preferably is one elongate tooth. In the jaw end 26 of the lever member 18, a front ridge 86 is preferably comprised of two relatively smaller elongate teeth 88, 90, a middle ridge 92 is preferably comprised of four relatively smaller elongate teeth 94, 96, 98, 100, and a back ridge 102 preferably is one elongate tooth. Each of the teeth of a particular ridge are separated from adjacent teeth by V-shaped grooves (or slots) 103 in the ridge. With respect to the middle ridges 72, 92, the grooves 103 are offset such that they do not align when the clamp 14 is in a closed or partially closed position; i.e., the grooves 103 between teeth 74 and 76, 76 and 78, 78 and 80, etc. are located adjacent teeth 94, 96, 98, and 100, and the grooves 103 between teeth 94 and 96, 96 and 98, and 98 and 100 are located adjacent teeth 76, 78, and 80. Each of the ridges, e.g., ridge 102, preferably has a rear wall 104 which extends substantially perpendicular to the surface 60 from which the ridge extends, and a front wall 106 which extends from the surface 60 and curves toward the rear wall 104 such that the ridge in cross-section (FIGS. 2 and 2B) has a cuspid-like appearance.

Each of the smaller teeth 64, 66, 68, 70, 74, 76, 78, 80, 82, 88, 90, 94, 96, 98, and 100 preferably has the same length, approximately ¼ inch. The height of front ridges 62, 86 is preferably approximately 0.06–0.07 inch, the height of the middle ridges 72, 92 is preferably approximately 0.07–0.09 inch, and the height of the back ridges 84, 102 is preferably approximately 0.13–0.014 inch.

The front and middle ridges 62, 72 on the base member 16 are separated by preferably approximately 0.12 inch, as are the front and middle ridges 86, 92 on the lever member 18. The middle and back ridges 72, 84 on the base member 16 are also separated by preferably approximately 0.12 inch, as are the middle and back ridges 92, 102 on the lever member 18.

Figure 7:
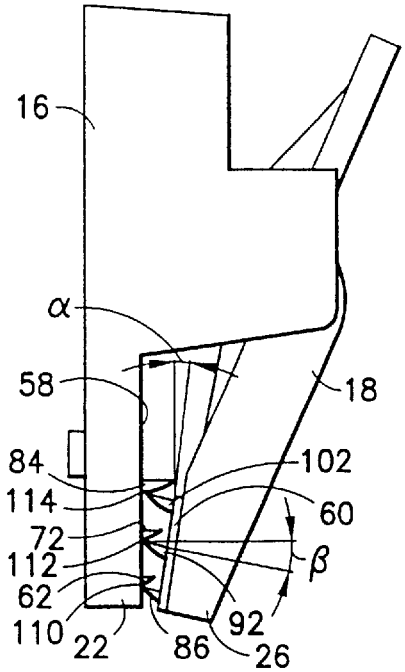
FIG. 7 is an enlarged broken side view of the left clamp in FIG. 1 in a closed position.

Referring now to FIG. 7, the surface 60 on the jaw end 26 of lever member 18 is angled at an angle $\alpha$ relative to the surface 58 on the jaw end 22 of the base member 16. When the jaw ends are in the closed position (FIG. 2A), angle $\alpha$ is preferably between 5° and 25°, and more preferably approximately 12°. In addition, while it was previously stated that the rear walls of the ridges are substantially perpendicular to the clamp surfaces, each of the ridges of lever 18 preferably angle backward relative to a normal to surface 60 by a small angle $\beta$ which is between 1° and 10°, and most preferably approximately 3°. These relative angles $\alpha$ and $\beta$, as well as the ridge configuration provide that when the base and lever members 16, 18 are in the fully closed position, the front ridge 86 of the lever member 18 is directed toward a front base 110 of the front ridge 62 of the base member 16, the middle ridge 92 of the lever member 18 is directed toward a front base 112 of the middle ridge 72 of the base member, and the back ridge 102 of the lever member 18 is directed toward a front base 114 of the back ridge 84 of the base member. In each case, in the fully closed position, the ridges of lever 18 preferably contact (or nearly contact) the ridges of the base 16 at an angle of between 6° and 35° (and most preferably approximately 15°) when the clamp is fully closed.

Figure 2C:
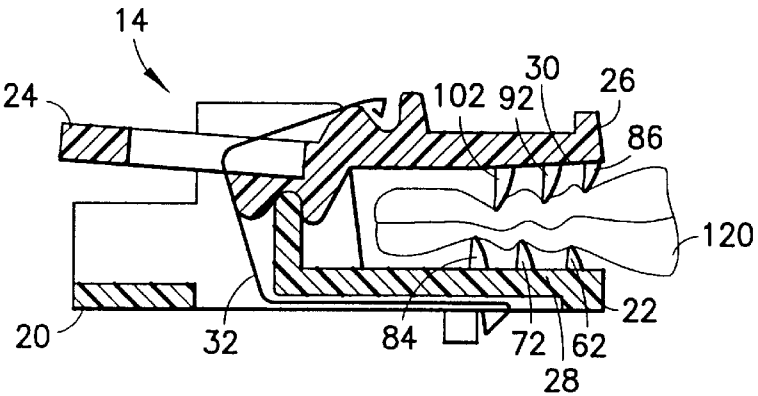
FIG. 2C is a sectional view of the garment clamp according to the first embodiment of the invention taken along line 2—2 in FIG. 1, with the jaw members shown closed on a portion of a denim jeans garment.
Figure 3:
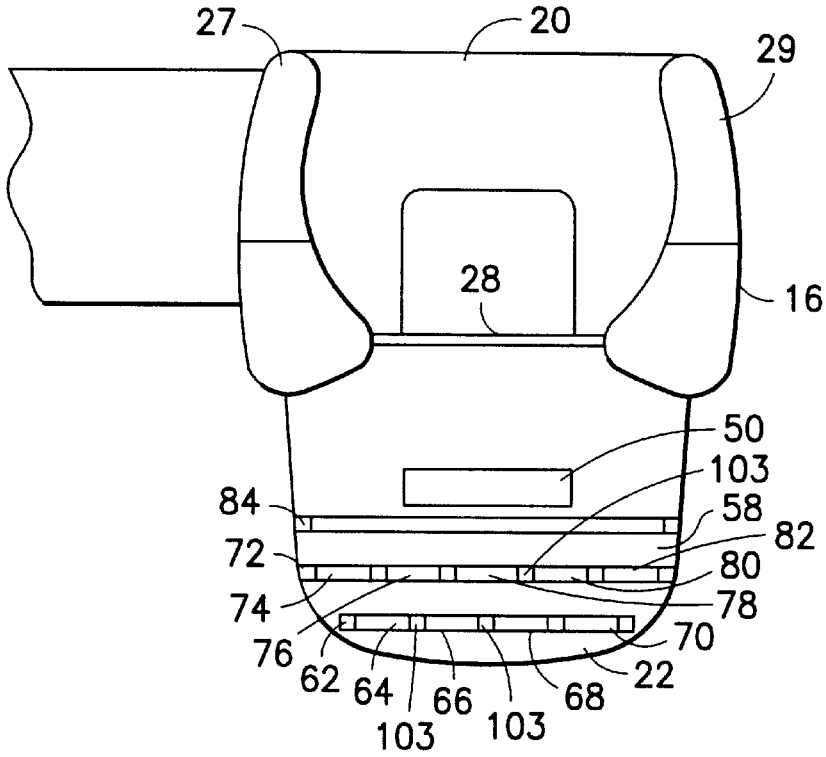
FIG. 3 is a broken front view of an inside of a first jaw member of the garment clamp according to the first embodiment of the invention shown attached to a part of a hanger body.
Figure 4:
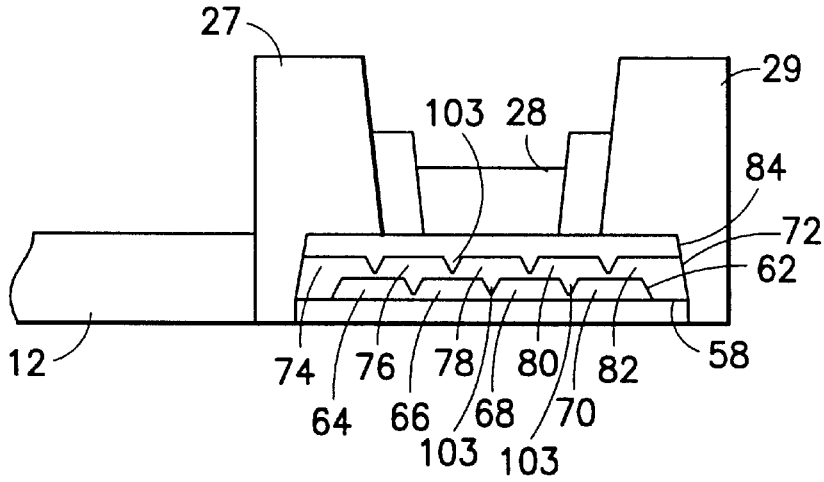
FIG. 4 is bottom view of the first jaw member shown in FIG. 3, shown attached to a part of a hanger body.
Figure 5:
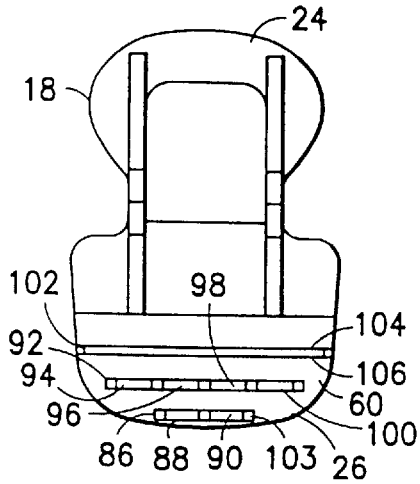
FIG. 5 is inside view of a second jaw member of the garment clamp according to the first embodiment of the invention.
Figure 6:
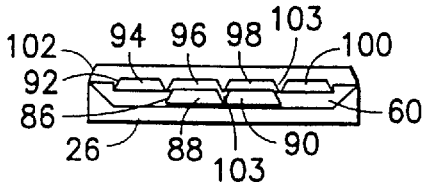
FIG. 6 is bottom view of the second jaw member shown in FIG. 5.

In use, jaw ends 22, 26 are spread apart by application of pressure to the handle portions 20, 24 sufficient to overcome the bias of the spring clip 32. With the jaw ends spread, a garment such as denim jeans can be received between the jaw ends or released from between the gripping surfaces of the jaw ends. Referring to FIG. 2C, to secure a garment 120 in the clamp 14, a part of the garment is positioned between the gripping surfaces 28, 30 of the jaw ends 22, 26, the handle portions 20, 24 are released, and the gripping surfaces are allowed to come together under the urging of the spring clip 32 and contact the garment 120. With a typical pair of denim jeans, when the clamp is closed about the jeans, ridges 62, 72 and 84 are offset from ridges 86, 92, 102. The shape and configuration of the ridges provide a superior gripping ability on denim jeans garments and prevent the premature release of a garment from the hanger, thereby eliminating the loss, damage and time (and thus cost) required to re-hang garments when garments are prematurely released. While having excellent ability to securely hold a garment, the clamps of the hanger also permit ready release of the garment from the hanger clamp when desired, and do not damage the denim garment while holding it.

Figure 8:
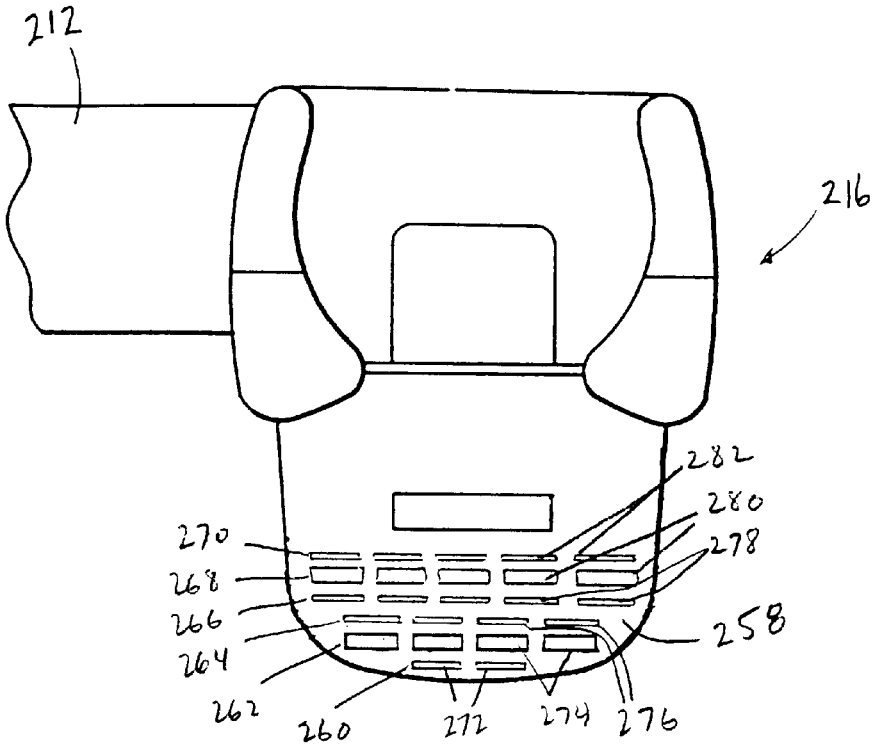
FIG. 8 is a broken front view of an inside of a first jaw member of a garment clamp according to a second embodiment of the invention, shown attached to a part of a hanger body.
Figure 9:
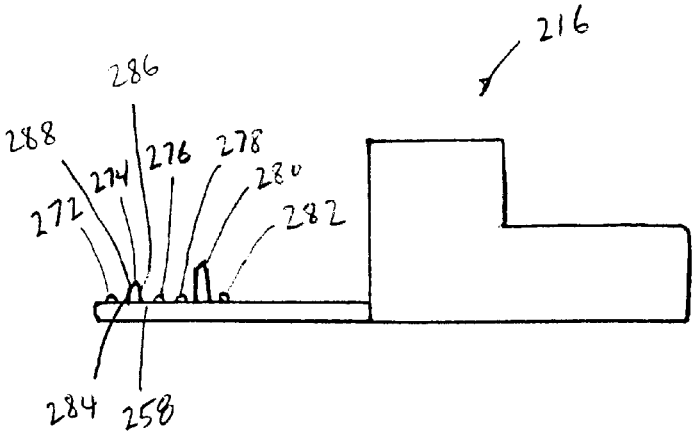
FIG. 9 is a side view of the first jaw member of the left clamp.

Turning now to FIGS. 8 through 12, a second embodiment of a pinch-type clamp 214 (FIG. 12) for a hanger body of a garment hanger is shown. The clamp 214 includes a base member 216 and a lever member 218, generally configured and assembled as discussed above with respect to members 16 and 18 of the first embodiment. Referring particularly to FIGS. 8 and 9, the clamping surface 258 of the base member 216 includes six rows of preferably discrete teeth: first row 260, second row 262, third row 264, fourth row 266, fifth row 268, and sixth row 270. The first row 260 includes two teeth, 272; the second and third rows 262, 264 each includes four teeth 274, 276, respectively; and the fourth, fifth and sixth rows 266, 268, 270 each include five teeth 278, 280, 282, respectively. All teeth in any given row are preferably of like size and shape, and all the teeth in all the rows preferably have a substantially similar lateral width (approximately 0.20 inch). The teeth 272, 276, 278 and 282 (in the first, third, fourth, and sixth rows) are preferably all of a common size; i.e., approximately 0.035 inch in height and approximately 0.03 inch in depth. The teeth 274 in the second row 262, with a height of approximately 0.075 inch and a depth of approximately 0.05 inch, are preferably substantially at least twice the height of the teeth 272, 276, 278 and 282. Teeth 274 include a front side 284, a back side 286 slightly taller than the front side, and a bite surface 288 extending between the front and back sides. The angle between the bite surface 288 and the front side 284 is preferably obtuse, while the angle between the bite surface 288 and the back side 288 is preferably acute. The teeth 280 in the fifth row 266, with a height of approximately 0.15 inch and a depth of approximately 0.09 inch, are preferably approximately twice the height and twice the depth of teeth 274, and are also configured similar to teeth 274, with a front side 290, a back side 292 slightly taller than the front side, and an upper surface 294 extending between the front and back sides.

Figure 10:
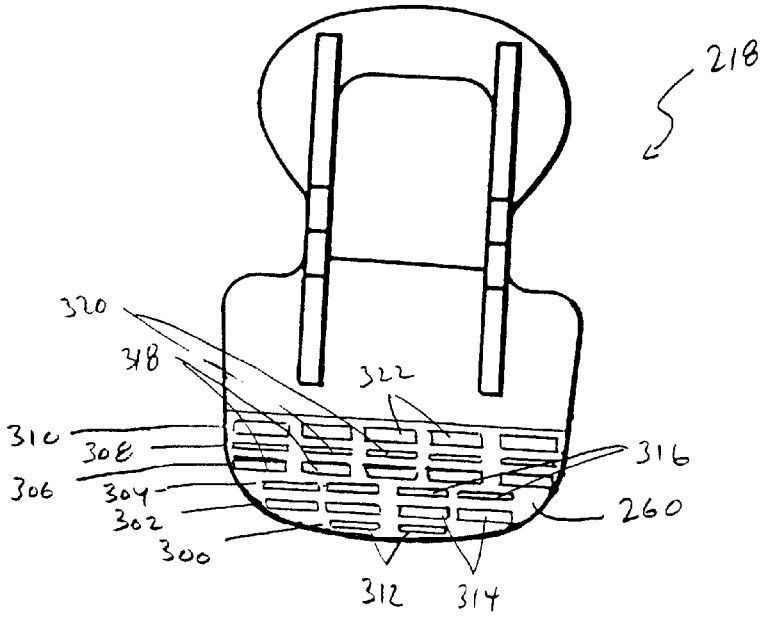
FIG. 10 is an inside view of a second jaw member of the second embodiment of the garment clamp.
Figure 11:
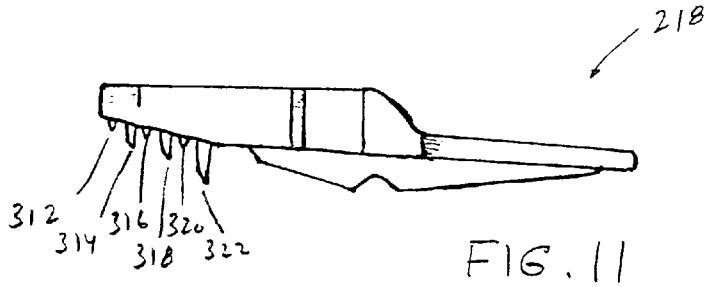
FIG. 11 is a side view of the second jaw member of FIG. 10.

Referring now to FIGS. 10 and 11, the clamping surface 260 of the lever member 218 also includes six rows of teeth: first row 300, second row 302, third row 304, fourth row 306, fifth row 308, and sixth row 310. The first row 300 includes two teeth, 312; the second and third rows 302, 304 each includes four teeth 314, 316, respectively; and the fourth, fifth and sixth rows 306, 308, 310 each include five teeth 318, 320, 322, respectively. All teeth in any given row are preferably of like size and shape, and all the teeth in all the rows preferably have a substantially similar lateral width; i.e., 0.020 inch. The teeth 316, 320 in the third and fifth rows 304, 310 are preferably all of a common size (approximately 0.06 inch in height and approximately 0.05 inch in depth) and slightly larger than the teeth 312 in the first row 300 (approximately 0.05 inch in height and approximately 0.04 inch in depth), as well as larger than the teeth 272, 276, 278, 282 of the first, third, fourth and sixth rows 260, 264, 266, 270 of the base member 216. The 16 teeth 314 in the second row 302 (approximately 0.08 inch in height and approximately 0.05 inch in depth) are substantially taller than the teeth 316, 320 in the third and fifth rows, and are configured similarly to teeth 274 of the base member (i.e., with front side, a relatively taller back side and bite surface). The teeth 318 in the fourth row 306 (approximately 0.09 inch in height and approximately 0.07 inch in depth) are configured similar to teeth 314, but are preferably taller and deeper than teeth 314. The teeth 322 in the sixth row 310 (approximately 0.15 inch in height and approximately 0.08 inch in depth) are configured similar to teeth 318, but are preferably approximately fifty percent taller than the teeth 318 while maintaining a similar depth relative to teeth 318.

Figure 12:
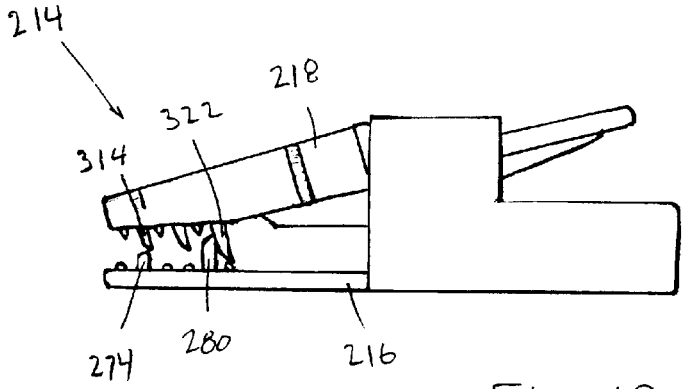
FIG. 12 is a side view of the left clamp according to the second embodiment of the invention.

Referring to FIG. 12, when the base and lever jaw members 216, 218 are moved into a closed position, the teeth 280 of the fifth row of the base member 216 ride against the bite surface and then the front side of the teeth 322 of the sixth row 310 of the lever member 218. In addition, the teeth 280 also contact the teeth 320 in the fifth row 308 of lever member 218. Furthermore, the teeth 274 of the second row 262 of the base member 216 abut the bite surface of the teeth 314 of the second row 302 of the lever member 218. The other teeth of the lever member 218 overlie teeth on the base member 216, preferably without contacting such overlying teeth.

The shape and configuration of the teeth of the second embodiment also provide superior gripping, and are particularly useful for both denim jeans and other garments to prevent premature release of the garment from the hanger. In addition, the particular configuration of the teeth has been shown to prevent damage to garments.

There have been described and illustrated herein embodiments of clamp for a reusable garment hanging device. While particular embodiments of the invention have been described, it is not intended that the invention be limited thereto, as it is intended that the invention be as broad in scope as the art will allow and that the specification be read likewise. Thus, while a particular number of ridges or teeth rows are preferred, it will be appreciated that fewer or more than described may be used. Also, while particular dimensions and relative angles are provided for the ridges, it will be appreciated that other dimensions and relative angles may be used. In addition, while the clamp is shown securely attached to the hanger body as an integral part of hanger body, it will be understood that this attachment method is merely illustrative of the most cost effective method of manufacturing a sturdy, attractive hanger. Furthermore, the clamp may alternatively be made separately from a material that is the same or different from the material of hanger body, and may be fixedly or movably attached to the hanger body by known means or methods. Moreover, the clamp may also be attached to hanger body by one or more intervening elements, such as, for example, a bar or rod (not shown) supported below hanger body. It will therefore be appreciated by those skilled in the art that yet other modifications could be made to the provided invention without deviating from its spirit and scope as claimed.

What is claimed is:

1. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein each of said first and second jaw ends includes a plurality of substantially parallel rows of teeth extending transversely across respective said jaw ends, said teeth of all of said rows having substantially a common width, said first jaw end including a plurality of rows of teeth of a first height, a row of teeth of a second height greater than said first height, and a row of teeth of a third height greater than said second height, said second jaw end including a plurality of rows of teeth of a fourth height, a row of teeth of a fifth height greater than said fourth height, and a row of teeth of a sixth height greater than said fifth height and a row of teeth of a seventh height greater than said sixth height.

2. A garment hanger according to claim 1, wherein:

each of said first and second jaw ends includes exactly six rows of teeth.

3. A garment hanger according to claim 2, wherein:

said first jaw end includes a first row having exactly two teeth; second and third rows having exactly four teeth; and fourth, fifth, and sixth rows having exactly five teeth.

4. A garment hanger according to claim 2, wherein:

said second jaw end includes a first row having exactly two teeth; second and third rows having exactly four teeth; and fourth, fifth, and sixth rows having exactly five teeth.

5. A garment hanger according to claim 3, wherein:

said second and fifth rows of teeth include teeth having a front side, a relatively taller back side, and a surface extending between said front and back sides.

6. A garment hanger according to claim 5, wherein:

said front side and said surface define an obtuse angle, and said back side and said surface define an acute angle.

7. A garment hanger according to claim 2, wherein:

with respect to said first jaw end, said teeth in a fifth row of said six rows of teeth are substantially twice a height of said teeth in a second row of said six rows.

8. A garment hanger according to claim 2, wherein:

with respect to said first jaw end, said teeth in a fifth row of said six rows of teeth are substantially twice a depth of said teeth in a second row of said'six rows.

9. A garment hanger according to claim 2, wherein:

with respect to said second jaw end, said teeth in third and fifth rows are of a substantially same size, said size being different from a size of said teeth in said first, second, fourth and six rows.

10. A garment hanger according to claim 9, wherein:

with respect to said second jaw end, said teeth in said third and fifth rows are larger than teeth in first, third, fourth and sixth rows of the first jaw end.

11. A garment hanger according to claim 9, wherein:

with respect to said second jaw end, said teeth in said second row are taller than said teeth in said third and fifth rows.

12. A garment hanger according to claim 11, wherein:

said teeth in said fourth row are taller than said teeth in said second row.

13. A garment hanger according to claim 12, wherein:

said teeth in said sixth row are taller than said teeth in said fourth row.

14. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein said first and second jaw ends each includes substantially parallel rows of teeth extending transversely across respective said jaw ends, said first and second jaw ends each including two rows of four teeth, and three rows of five teeth.

15. A garment hanger according to claim 14, wherein:

said first and second jaws each include a first row of two teeth; second and third rows of four teeth; and fourth, fifth and sixth rows of five teeth.

16. A garment hanger according to claim 15, wherein:

in said first jaw end, said second and fifth rows have teeth which are taller than teeth in said first, third, fourth and sixth rows.

17. A garment hanger according to claim 16, wherein:

said teeth in said fifth row are taller than said teeth in said second row.

18. A garment hanger according to claim 16, wherein:

said teeth in said fifth row are deeper than said teeth in said second row.

19. A garment hanger according to claim 15, wherein:

in said second jaw end, said second, fourth, and sixth rows have teeth which are taller than teeth in said first, third, and fifth rows.

20. A garment hanger according to claim 19, wherein:

said teeth in said fourth row are taller than said teeth in said second row.

21. A garment hanger according to claim 20, wherein:

said teeth in said sixth row are taller than said teeth in said fourth row.

22. A garment hanger according to claim 15, wherein:

said teeth in said second and fifth rows of said first jaw end, and said teeth in said second, fourth and six rows of said second jaw end each have a front side, a relatively taller back side, and a surface extending between said front and back sides, said front side and said surface defining an obtuse angle, and said back side and said surface defining an acute angle.

23. A garment hanger, comprising:

a) a body;

b) a hook member coupled to said body from which said hanger can be suspended; and c) at least one clamp coupled to said body, said clamp having a base member having a first handle portion and a first jaw end, a lever member movable relative to said base member and having a second handle portion and a second jaw end, and a clip coupling said base member and said lever member together such that said first and second jaw ends are urged toward each other into a closed position, wherein said first and second jaw ends each includes substantially parallel rows of teeth extending transversely across respective said jaw ends, wherein, when in said closed position, a first row of each of said first and second jaw ends contact each other, a second row of each of said first and second jaw ends contact each other, and at least one intermediate row of each of said first and second jaw ends between said first and second rows are spaced apart.

24. A garment hanger according to claim 23, wherein:

said at least one intermediate row of each of said first and second jaw ends are situated substantially across from each other.

25. A garment hanger according to claim 23, wherein:

in said closed position, said second row of teeth of said first jaw member is in contact with said second row of said second jaw member and a row of teeth adjacent said second row of said second jaw member.

* * * * *